US008253593B2

(12) United States Patent
Jia et al.

(10) Patent No.: US 8,253,593 B2
(45) Date of Patent: Aug. 28, 2012

(54) TRAFFIC LIGHT SYSTEM AND METHOD FOR USING THE SAME

(75) Inventors: Li-Jin Jia, Shenzhen (CN); Shu-Qing Wang, Shenzhen (CN); Dong-Xu Weng, Shenzhen (CN); Yuan Yao, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 422 days.

(21) Appl. No.: 12/563,256

(22) Filed: Sep. 21, 2009

(65) Prior Publication Data

US 2010/0259418 A1 Oct. 14, 2010

(30) Foreign Application Priority Data

Apr. 11, 2009 (CN) ..... 2009 1 0301492

(51) Int. Cl.
*G08G 1/00* (2006.01)

(52) U.S. Cl. ..... 340/928; 340/425.5; 340/815.45

(58) Field of Classification Search ..... 340/928, 340/906, 907, 463, 468, 425.5, 901, 904, 340/815.45, 475, 641–642, 438, 464
See application file for complete search history.

(56) References Cited

U.S. PATENT DOCUMENTS

| | | | | |
|---|---|---|---|---|
| 5,805,081 | A * | 9/1998 | Fikacek | 340/908 |
| 6,828,918 | B2 * | 12/2004 | Bowman et al. | 340/4.1 |
| 7,248,183 | B2 * | 7/2007 | Pfleging et al. | 340/907 |
| 7,633,408 | B2 * | 12/2009 | Yingst et al. | 340/908 |
| 2005/0040970 | A1 * | 2/2005 | Hutchins et al. | 340/907 |
| 2007/0143499 | A1 * | 6/2007 | Chang | 709/245 |

FOREIGN PATENT DOCUMENTS

| | | | |
|---|---|---|---|
| BE | 1014363 | A6 | 9/2003 |
| CN | 1588480 | A | 3/2005 |
| JP | 2002-352379 | A | 12/2002 |

* cited by examiner

*Primary Examiner* — Daniel Previl
(74) *Attorney, Agent, or Firm* — Altis Law Group, Inc.

(57) ABSTRACT

A traffic light system includes a traffic light unit and at least one reminding unit. The traffic light unit includes a plurality of traffic lights, a detecting module connected to the traffic lights, and a wireless communication module connected to the detecting module. Each reminding unit includes a central processing unit (CPU) and a signaling module, such as a speaker module connected to the CPU. The detecting unit detects the working statuses of the traffic lights and generates corresponding detect signals transmitted to the wireless communication module, the wireless communication module sends the detect signals to the reminding unit in a predetermined reminding area, the CPU processes the detect signals to obtain the workings statuses of the traffic lights and controls the speaker module to play corresponding audio signals to remind the user.

19 Claims, 2 Drawing Sheets

TRAFFIC LIGHT SYSTEM AND METHOD FOR USING THE SAME

BACKGROUND

1. Technical Field

The present disclosure relates to traffic light systems and methods for using the same, and particularly to a traffic light system being applicable to the blind, those with eye strain, or the colorblind and a method for using the same.

2. Description of Related Art

Most conventional traffic lights use red, green and yellow optical signals to indicate different traffic statuses. Obviously, these traffic lights cannot provide help to the blind, and those with eye strain and the colorblind may be not able to distinguish different optical signals of these traffic lights.

Furthermore, the traffic lights are usually used in busy and noisy roads. Therefore, despite broadcast corresponding to the traffic lights is broadcast on the roads to indicate different traffic statuses, the blind, those with eye strain and the colorblind passing through the roads may be disturbed by noises and cannot know the traffic statuses.

Therefore, there is room for improvement within the art.

BRIEF DESCRIPTION OF THE DRAWINGS

Many aspects of the present traffic light system and method for using the same can be better understood with reference to the following drawings. The components in the various drawings are not necessarily drawn to scale, the emphasis instead being placed upon clearly illustrating the principles of the present traffic light system and method for using the same. Moreover, in the drawings, like reference numerals designate corresponding parts throughout the figures.

DETAILED DESCRIPTION

Figure 1:
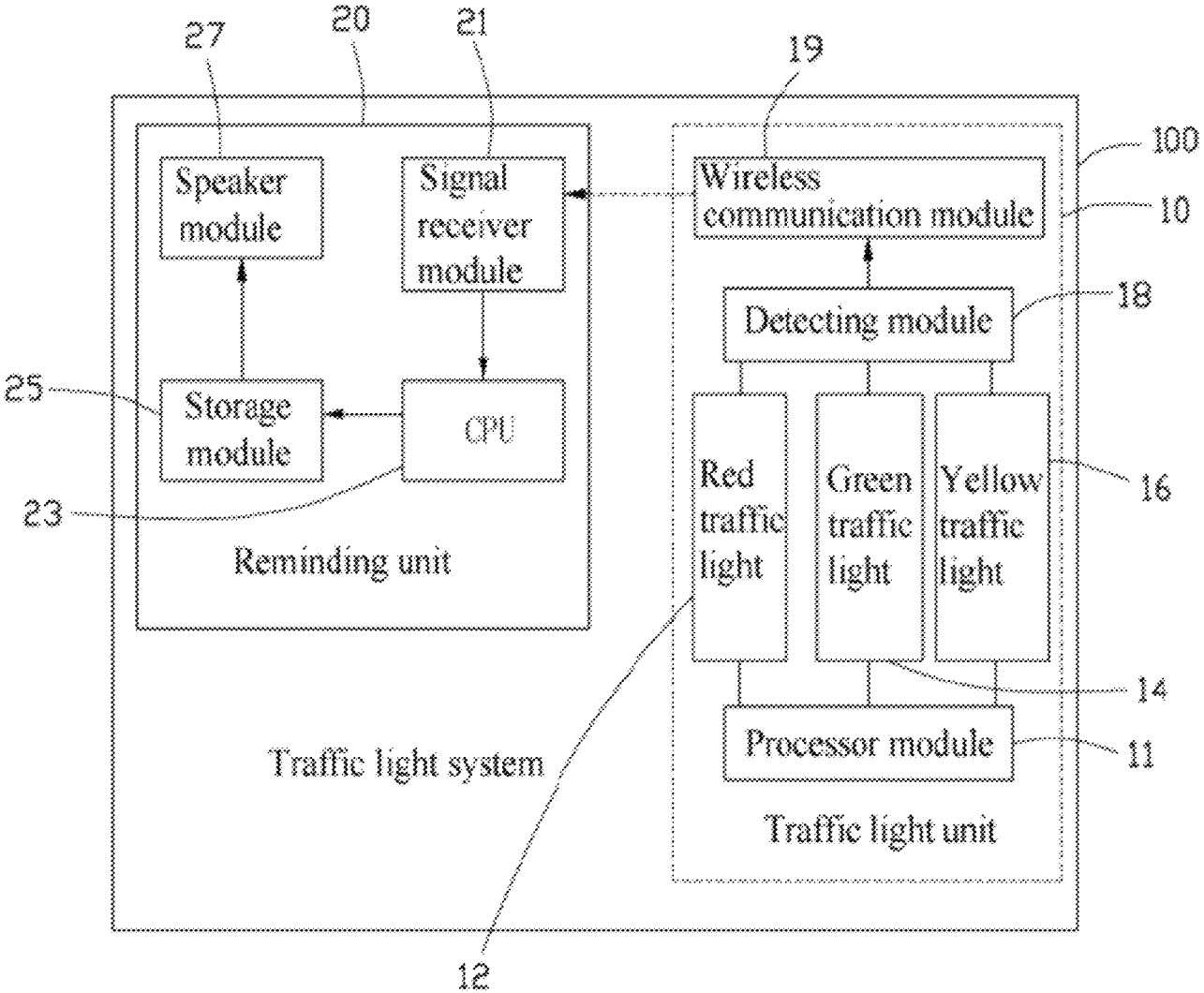
FIG. 1 is a block diagram of a traffic light system, according to an exemplary embodiment.

FIG. 1 shows a traffic light system 100 according to an exemplary embodiment. The traffic light system 100 includes a fixed traffic light unit 10 and at least one portable reminding unit 20.

The traffic light unit 10 includes a processor module 11, a plurality of traffic lights (e.g., a red traffic light 12, a green traffic light 14 and a yellow traffic light 16, as shown in FIG. 1), a detecting module 18 and a wireless communication module 19. The traffic lights 12, 14, 16 are all electronically connected to the processor module 11 to be controlled by the processor module 11. The detecting module 18 is electronically connected to the traffic lights 12, 14, 16. The wireless communication module 19 is electronically connected to the detecting module 18.

The processor module 11 can be a computer, a single chip, a microprocessor, etc. The processor module 11 can automatically time and controls the traffic lights 12, 14, 16 to be switched on at predetermined times. Understandably, the processor module 11 can also be operated to manually control the traffic lights 12, 14, 16. The traffic lights 12, 14, 16 can be conventional traffic lights respectively emitting red, green and yellow light to indicate different traffic statuses.

The detecting module 18 is a sampling circuit module. The detecting module 18 can continuously detect the working statuses of the traffic lights 12, 14, 16 and generate electronic detect signals according to the detected workings statuses of the traffic lights 12, 14, 16 at a predetermined frequency. The wireless communication module 19 can be a radio frequency antenna, a Bluetooth module, etc. The wireless communication module 19 is used to transmit the detect signals of working statuses of the traffic lights 12, 14, 16 to reminding units 20 in a predetermined area.

The reminding unit 20 can be integrated with a portable electronic device, such as a mobile phone, a personal digital assistant (PDA), a Bluetooth earphone, etc. The reminding unit 20 includes a signal receiver module 21, a central processing unit (CPU) 23, a storage module 25 and a signaling module, such as a speaker module 27 electronically connected together in series. The signal receiver module 21 corresponds to the wireless communication module 19 and can be a radio frequency antenna, a Bluetooth module etc. When the reminding unit 20 is in a predetermined reminding area (e.g., when the reminding unit 20 and the traffic light 10 is within a predetermined coverage range), the signal receiver module 21 can wirelessly communicate with the wireless communication module 19 to receive detect signals. The CPU 23 can process the detect signals received by the receiver module 21 to obtain the statuses of the traffic lights 12, 14, 16, and then controls the speaker module 27 to play audio signals corresponding to the workings statuses of the traffic lights 12, 14, 16. The storage module 25 stores audio files to be played by the speaker module 27.

The signal receiver module 21, the CPU 23, the storage module 25 and the speaker module 27 can be integrated with portable electronic devices. For example, when the reminding unit 10 is a mobile phone, the conventional antenna, CPU, memorizer and speaker/earphone of the mobile phone can serve as the signal receiver module 21, the CPU 23, the storage module 25 and the speaker module 27, correspondingly. The traffic light system 100 can further operate in coordination with multiple reminding units 20, wherein the signal receiver module 21 of each reminding unit 20 in the reminding area can wirelessly communicate with the wireless communication module 19.

Figure 2:
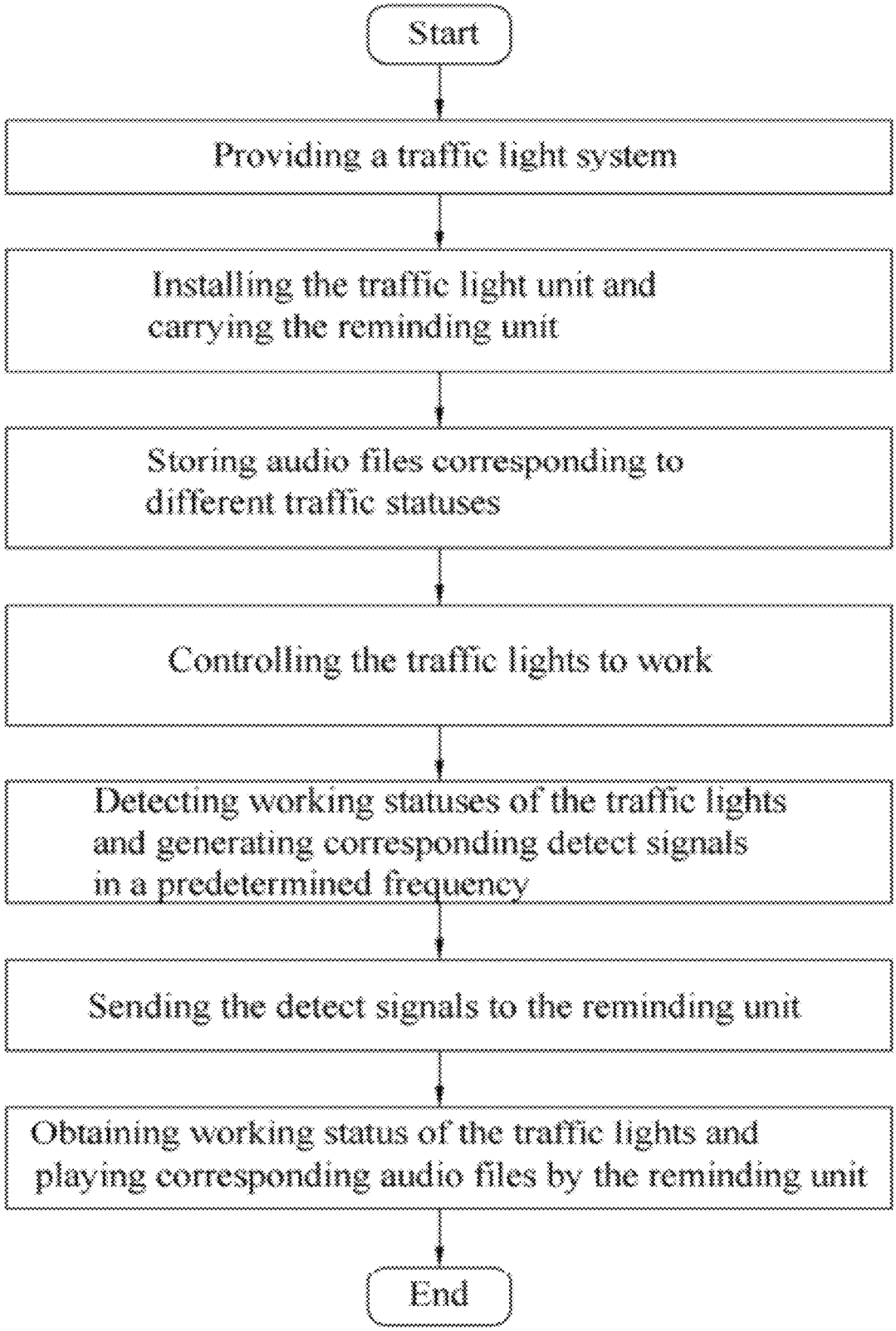
FIG. 2 is a flow chart of a method for using the traffic light system shown in FIG. 1.

Also referring to FIG. 2, a method for using the above-mentioned traffic light system 100 to indicate traffic statuses is shown. The method may include these following steps.

First, a traffic light system 100 is provided. The traffic light unit 10 is fixed on a road. A reminding unit 20 is carried by a user, and a predetermined coverage range (i.e., the reminding area) in which the signal receiver module 21 can wirelessly communicate with the wireless communication module 19 is set.

Second, reminding audio files corresponding to different traffic statuses are stored in the storage module(s) 25. For examples, audio files for reminding the users to stop are set and stored to correspond to the working status of switching the red traffic light 12 on. Audio files for reminding the users to pass are set and stored to correspond to the working status of switching the green traffic light 14 on.

After storing the audio signals, the processor module 11 controls the traffic lights 12, 14, 16 to work. Understandably, the traffic lights 12, 14, 16 can work according to conventional methods.

When the traffic lights 12, 14, 16 works, the detecting module 18 continuously detects the working statuses of the traffic lights 12, 14, 16 and generates electronic detect signals corresponding to the working statuses in a predetermined frequency. The detect signals are then transmitted to the wireless communication module 19 to be transmitted to reminding unit(s) 20 in a predetermined reminding area (e.g., an area surrounding the traffic light unit 10) at the predetermined frequency.

When a user carrying a reminding unit 20 is in the reminding area, the signal receiver module 21 periodically receives current detect signals sent by the wireless communication module 19 at the predetermined frequency. The CPU 23 processes the detect signals to obtain the current workings statuses of the traffic lights 12, 14, 16, and then controls the speaker module 27 to play audio signals stored in the storage module 25 according to the workings statuses of the traffic lights 12, 14, 16. For example, when the red traffic light 12 is switched on, the CPU 23 controls the speaker module 27 to play the audio files of reminding the user to stop. When the green traffic light 14 is switched on, the CPU 23 controls the speaker module 27 to play the audio files of reminding the user to pass. When the yellow traffic light 16 is switched on, the CPU 23 controls the speaker module 27 to play the audio files of reminding the user to stop or pass soon.

In use, when the users carrying the reminding units 20 are in the reminding area of the present traffic light system 100, they can be reminded by audio signals played by the speaker module 27. Despite the users are blind, have eye strain or are colorblind, they can easily know the statuses of the traffic light unit 10 and act correctly according to the reminding audio signals. Thus, the present traffic light system 100 can provide visual traffic indications to common users according to conventional methods, and can also provide aural traffic indications to the blind, those with eye strain or the colorblind users.

Furthermore, the reminding unit 20 can be integrated with conventional portable electronic devices. Thus, the reminding unit 20 is easy to carry. Particularly, when an earphone of a portable electronic device serves as the speaker module 27, outside noises can be prevented from disturbing the users. Additionally, the reminding unit(s) 20 can also transmit vibrating or other signals indicative of the traffic light statuses to the user.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A traffic light system, comprising:

a traffic light unit including a plurality of traffic lights, a detecting module connected to the traffic lights, and a wireless communication module connected to the detecting module; and at least one reminding unit carried by a user, each reminding unit including a central processing unit (CPU) and a signaling module connected to the CPU; wherein the detecting unit detects working statuses of the traffic lights and generates corresponding detect signals transmitted to the wireless communication module, the wireless communication module sends the detect signals to the reminding unit in a predetermined reminding area, the CPU processes the detect signals to obtain the workings statuses of the traffic lights and controls the signaling module to inform the user of the statuses of the traffic lights.

2. The traffic light system as claimed in claim 1, wherein the detecting module continuously detects the working statuses of the traffic lights and generates corresponding detect signals at a predetermined frequency, and the detect signals are sent to the reminding units in the predetermined reminding area at the predetermined frequency.

3. The traffic light system as claimed in claim 1, wherein the reminding unit includes a signal receiver module connected to the CPU, when the reminding unit is in the predetermined area, the signal receiver module wirelessly communicates with the wireless communication module to receive detect signals.

4. The traffic light system as claimed in claim 1, wherein the signaling module is a speaker module that can play audio signals informing the user of the statuses of the traffic lights.

5. The traffic light system as claimed in claim 4, wherein the reminding unit includes a storage module connected to the CPU and the signaling module, the storage module storing audio files for reminding the users.

6. The traffic light system as claimed in claim 1, wherein the traffic light unit includes a processor module connected to the traffic lights for automatically controlling the traffic lights to work.

7. The traffic light system as claimed in claim 1, wherein the reminding unit is integrated with a mobile phone or a personal digital assistant (PDA).

8. The traffic light system as claimed in claim 1, wherein the speaker module is an earphone.

9. The traffic light system as claimed in claim 1, wherein the detecting module is a sampling circuit module.

10. A method for indicating traffic statuses, comprising steps:

providing a traffic light system including a traffic light unit that includes a plurality of traffic lights and a detecting module connected to the traffic lights, and at least one reminding unit carried by a user;

controlling the traffic lights to work;

detecting working statuses of the traffic lights and generating corresponding detect signals by the detecting module of the traffic light unit;

sending the detect signals to the reminding unit; and obtaining the statuses of the traffic lights according to the detect signals and giving corresponding signals to inform the user of the status of the traffics lights.

11. The method as claimed in claim 10, wherein the step of giving corresponding signals to inform the user of the status of the traffics lights comprises playing corresponding audio files to inform the user.

12. The method as claimed in claim 11, further comprising a step of storing audio files corresponding to different traffic statuses in the reminding unit.

13. The method as claimed in claim 10, further comprising a step of setting a reminding area in which the reminding unit can receive detect signals.

14. A traffic light system, comprising:

a traffic light unit including a plurality of traffic lights and a detecting module connected to the traffic lights; and at least one reminding unit carried by users, each reminding unit includes a signal receiver module, a CPU connected to the signal receiver module, and a signaling module connected to the CPU; wherein the detecting module detects working statuses of the traffic lights and generates corresponding detect signals according to the detected working statuses of the traffic lights, the signal receiver module wirelessly receives the detect signals of predetermined traffic lights when the reminding unit is in a predetermined reminding area, the CPU processes the detect signals to obtain the workings statuses of the predetermined traffic lights and controls the signaling module to inform the user of the statuses of the traffics lights.

15. The traffic light system as claimed in claim 14, wherein the signaling module includes a speaker module and plays corresponding audio signals to inform the user of the statuses of the traffics lights.

16. The traffic light system as claimed in claim 15, wherein the reminding unit further includes a storage module connected to the CPU and the speaker module, the storage module storing audio files for reminding the users.

17. The traffic light system as claimed in claim 15, wherein the reminding unit is integrated with a mobile phone or a personal digital assistant (PDA).

18. The traffic light system as claimed in claim 15, wherein the speaker module is an earphone.

19. The traffic light system as claimed in claim 14, wherein the detecting module is a sampling circuit module.

* * * * *